US008210917B2

(12) United States Patent
Sip et al.

(10) Patent No.: US 8,210,917 B2
(45) Date of Patent: Jul. 3, 2012

(54) SIMULATED EYE FOR TOY

(75) Inventors: Kim-Yeung Sip, Shenzhen (CN); Yung-Hung Chu, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 287 days.

(21) Appl. No.: 12/612,661

(22) Filed: Nov. 4, 2009

(65) Prior Publication Data

US 2010/0311305 A1 Dec. 9, 2010

(30) Foreign Application Priority Data

Jun. 3, 2009 (CN) ..... 2009 1 0302875

(51) Int. Cl.
*A63F 9/24* (2006.01)

(52) U.S. Cl. ..... 463/4; 463/2; 446/43

(58) Field of Classification Search ..... 463/4, 2; 446/43, 343, 337; 351/221
See application file for complete search history.

(56) References Cited

U.S. PATENT DOCUMENTS

| | | | | |
|---|---|---|---|---|
| 4,179,842 | A * | 12/1979 | Fauls | 446/190 |
| 5,900,923 | A * | 5/1999 | Prendergast et al. | 351/221 |
| 2007/0128979 | A1 * | 6/2007 | Shackelford et al. | 446/484 |
| 2010/0151768 | A1 * | 6/2010 | Liu | 446/337 |

* cited by examiner

*Primary Examiner* — Pierre E Elisca
(74) *Attorney, Agent, or Firm* — Altis Law Group, Inc.

(57) ABSTRACT

A simulated eye is capable of being changed between a normal state and a dilated state. The simulated eye includes a circuit board, a controller electrically connected to the circuit board, a simulated iris electrically connected to the circuit board, and a simulated pupil. When the simulated iris is irradiated with light, the size of the colored area of the simulated iris is changeable by operationally powering on and powered off the simulated iris via the controller, whereby the simulated eye is changed between the normal state and the dilated state.

19 Claims, 6 Drawing Sheets

SIMULATED EYE FOR TOY

BACKGROUND

1. Technical Field

The disclosure relates to toys and, more particularly, to a simulated eye for a toy.

2. Description of Related Art

A typical toy replica of an eye has an eyelid that can open and close. Accordingly, other effects are needed to make the eyes more lifelike.

BRIEF DESCRIPTION OF THE DRAWINGS

The components of the drawings are not necessarily drawn to scale, the emphasis instead being placed upon clearly illustrating the principles of the embodiments of the simulated eye. Moreover, in the drawings, like reference numerals designate corresponding parts throughout several views.

DETAILED DESCRIPTION

Figure 1:
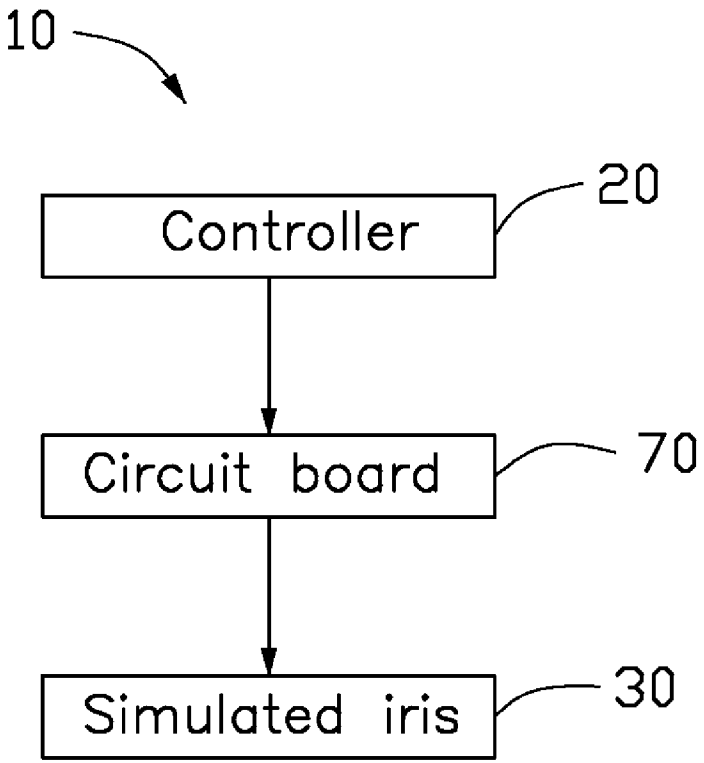
FIG. 1 is a block diagram of a simulated eye in accordance with one embodiment.
Figure 2:
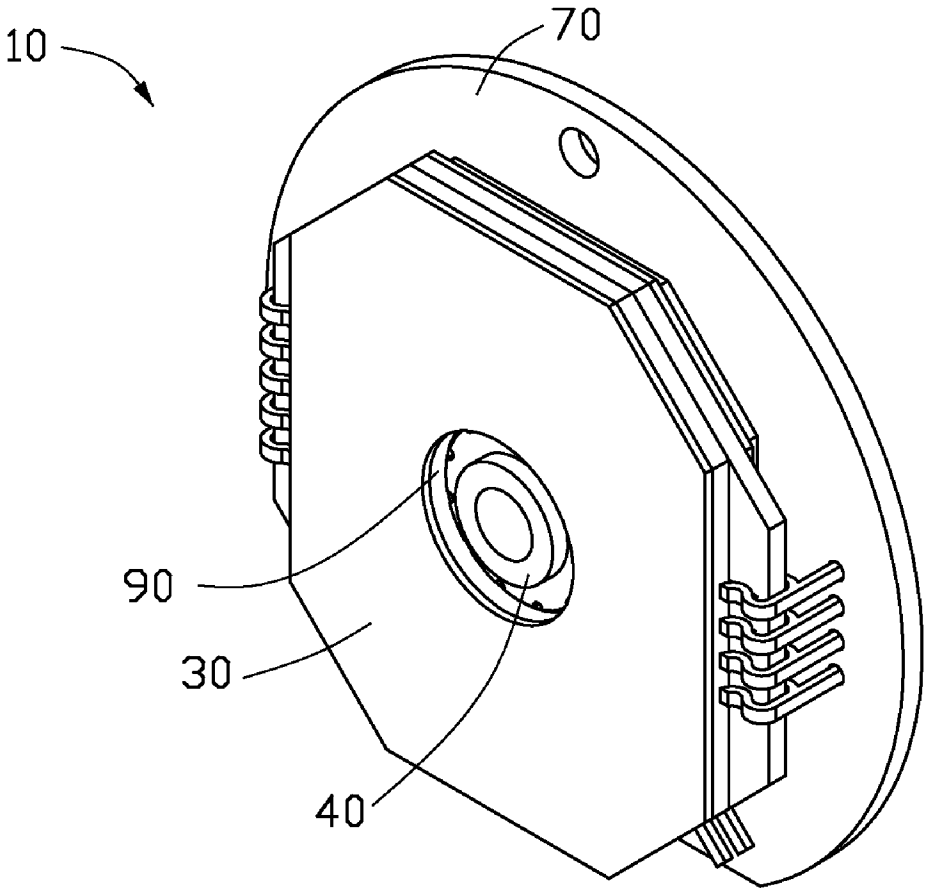
FIG. 2 is a perspective view of a part of a simulated eye in accordance with one embodiment.
Figure 3:
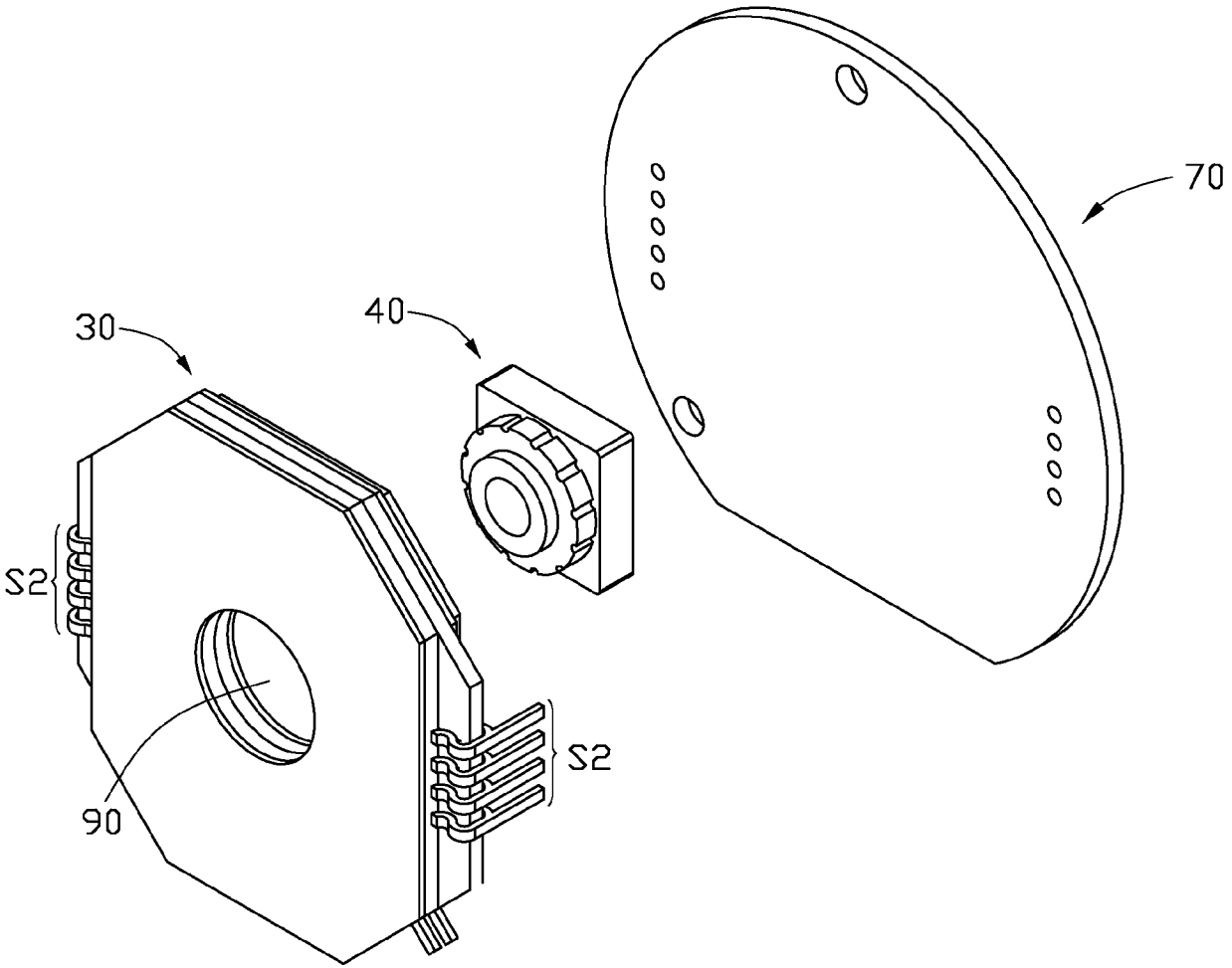
FIG. 3 is an exploded view of the simulated eye of FIG. 2, the simulated eye includes a simulated iris.

Referring to FIGS. 1-3, a simulated eye 10 includes a simulated iris 30, a simulated pupil 40, a circuit board 70, and a controller 20. The simulated iris 30 and the controller 20 are electrically connected to the circuit board 70. The circuit board 70 is configured to power the simulated iris 30. The simulated pupil 40 is fixed to the circuit board 70 and is visible through the simulated iris 30. The controller 20 controls the circuit board 70 to selectively power the simulated iris 30. A color of the simulated iris 30 changes when it receives power.

In the embodiment, the controller 20 is fixed to a backside of the circuit board 70, and is not shown in FIGS. 2-3. In other embodiments, the controller 20 may be integrated in the circuit board 70 or fixed to another component of a toy using the simulated eye 10.

The center of the simulated iris 30 defines a through hole 90. The simulated pupil 40 is visible through the through hole 90. The simulated pupil 40 is attached to the circuit board 70. The simulated eye 10 also includes a simulated eyeball (not shown). The circuit board 70 is housed in the simulated eyeball, such that the simulated iris 30 and the simulated pupil 40 are visible at the simulated eyeball.

The portion of the simulated pupil 40 exposed at the through hole 90 is round and is colored. When the simulated iris is supplied with electrical power, liquid crystal molecules in the simulated iris respond to an electric field generated by the electrical power, and a light transmission characteristic of light irradiated from the simulated iris is changed, such that a size of a colored area of the simulated iris is changed. The color of the simulated pupil 40 is darker than an initial color of the simulated iris 30. When the simulated iris 30 receives power from the circuit board 70, a size of the simulated iris 30 darkens, and all the darkened area in the simulated iris 30 and the simulated pupil 40 are considered as an apparent pupil hereinafter. In the embodiment, the color of the simulated pupil 40 is a dark color, and the initial color of the simulated iris 30 is brown. The simulated pupil 40 can function as a camera. In the embodiment, the simulated pupil 40 is a micro-camera. The lens of the micro-camera is exposed at the through hole 90 to capture images under control of the controller 20.

Figure 4:
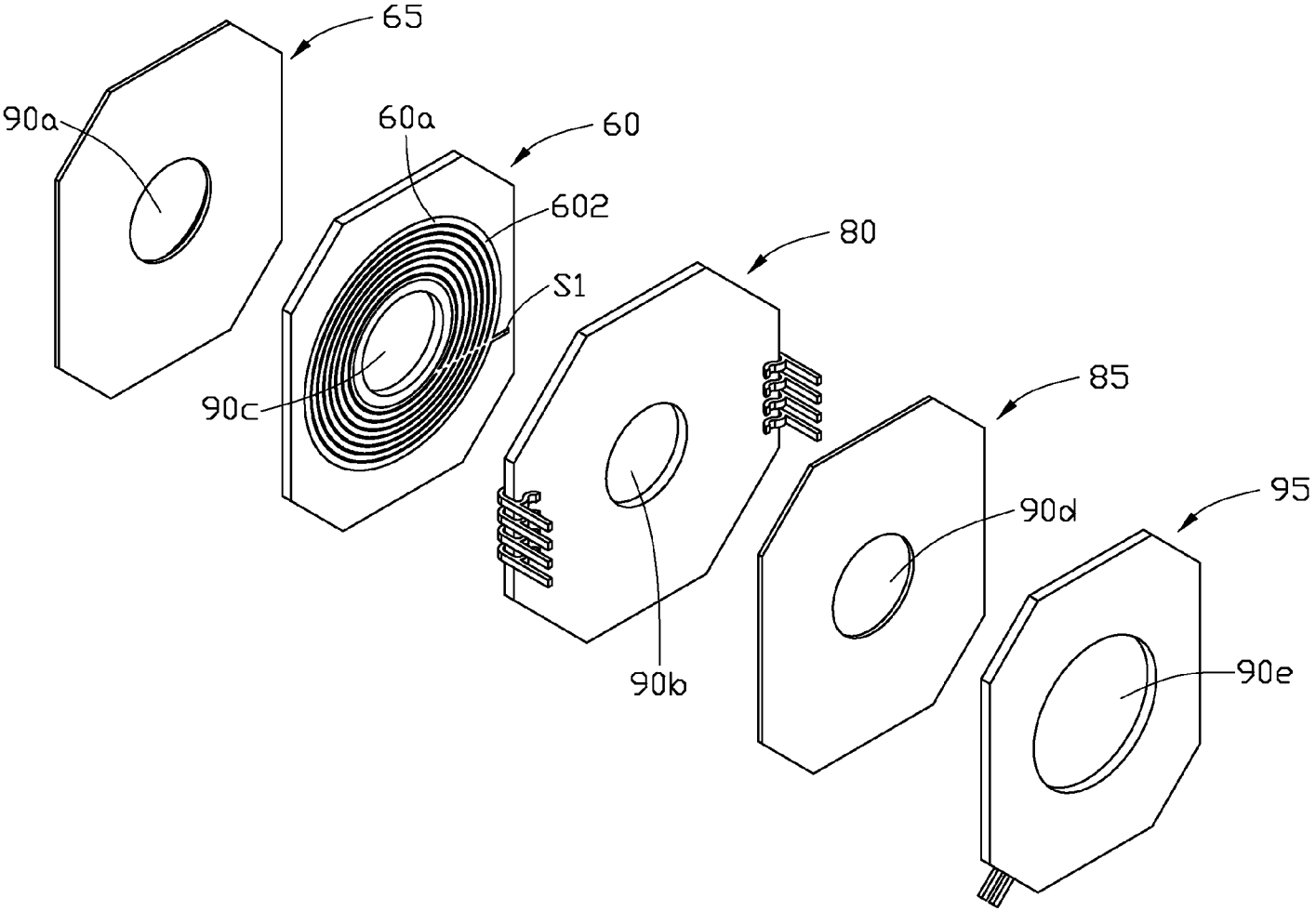
FIG. 4 is an exploded view of the simulated iris of the simulated eye of FIG. 3.
Figure 5:
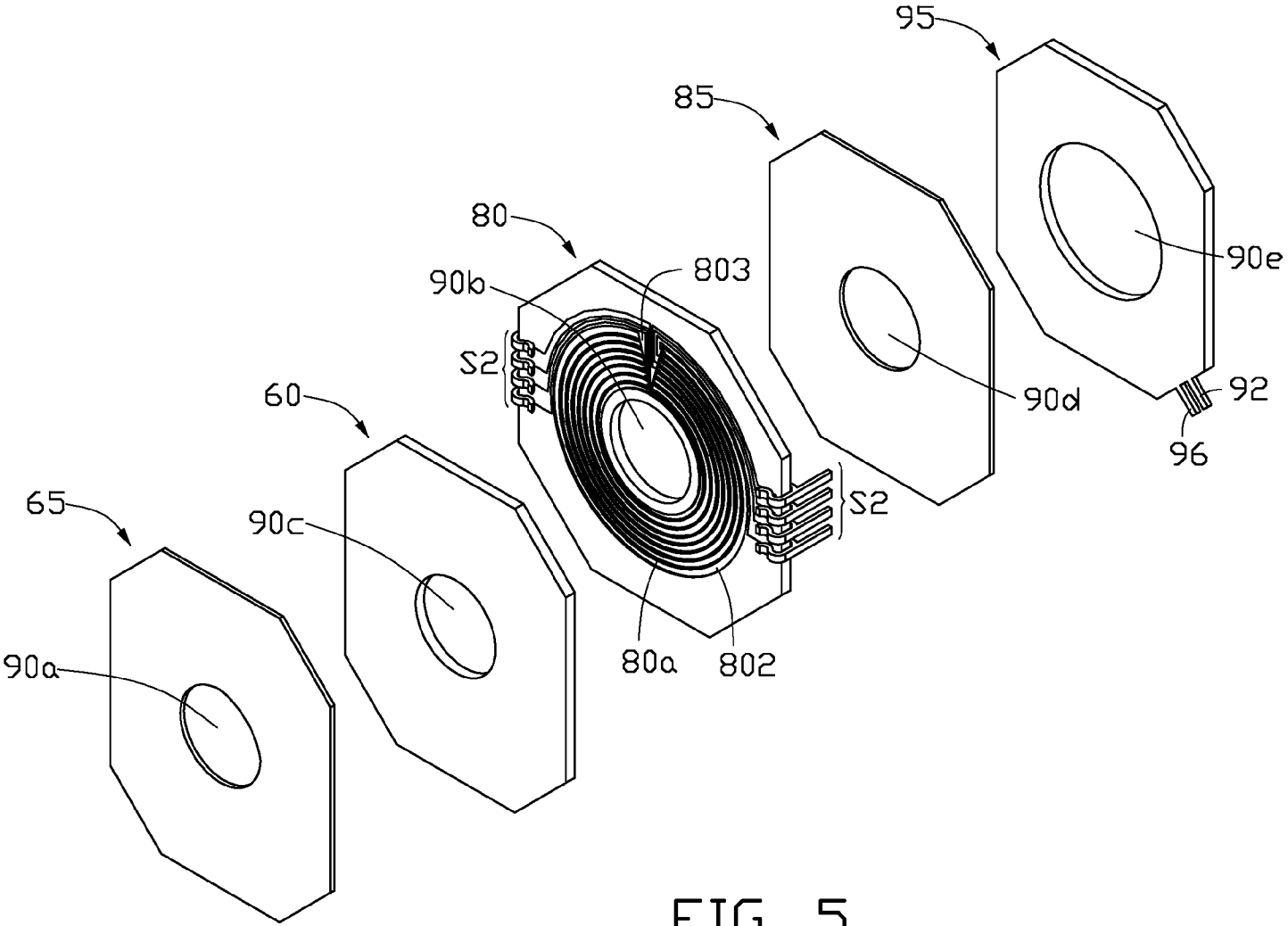
FIG. 5 is similar to FIG. 4, but viewed from another aspect, the simulated iris includes a second electro-conductive substrate.
Figure 6:
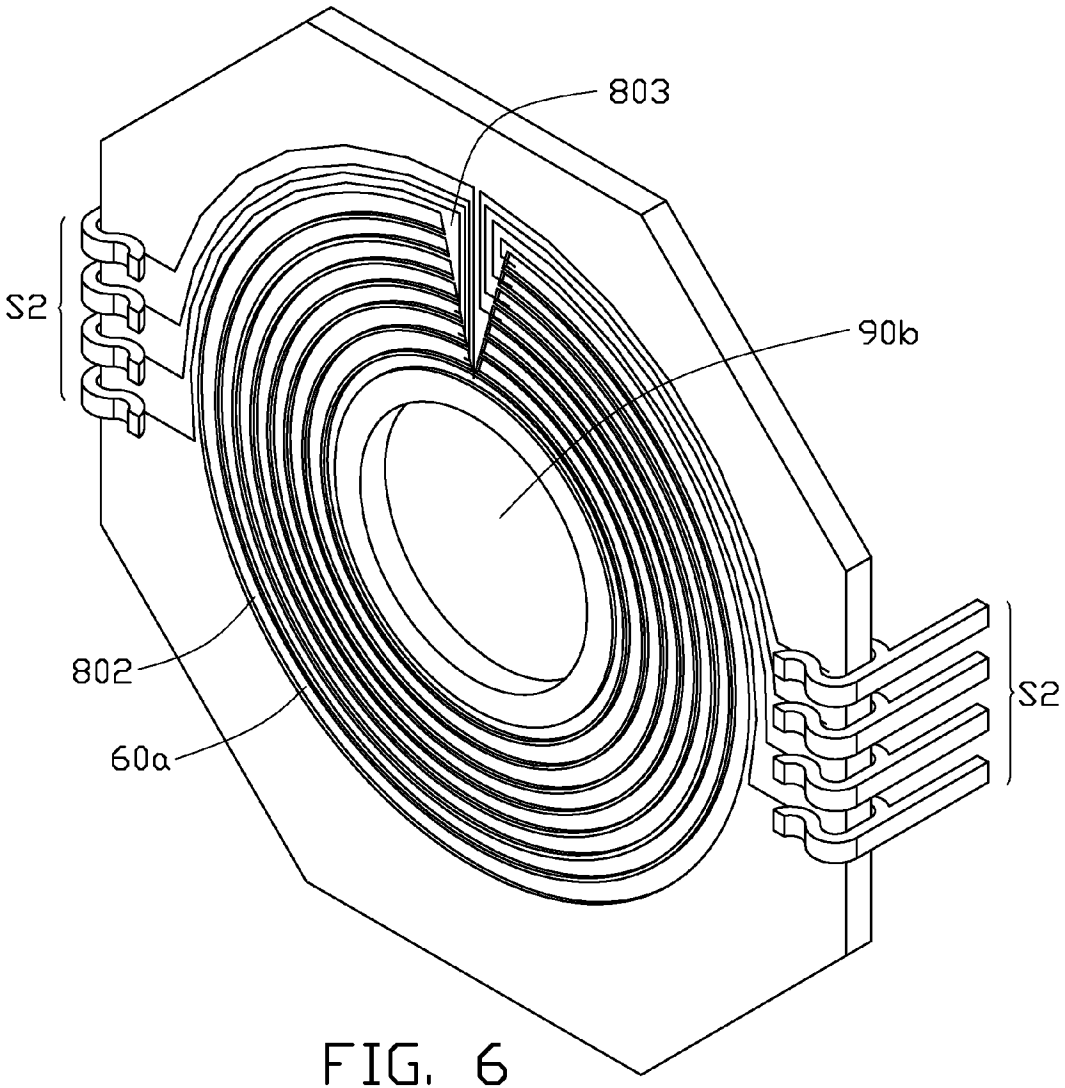
FIG. 6 is an enlarged perspective view of the second electro-conductive substrate of FIG. 5.

Referring also to FIGS. 4-5, the simulated iris 30 includes a first polarizer film 65, a transparent first glass substrate 60, a transparent second glass substrate 80, a second polarizer film 85, and an illuminating device 95. The polarizer films 65, 85, the transparent glass substrates 60, 80, and the illuminating device 95 are substantially hexagonal, and define a round hole 90*a*, 90*c*, 90*b*, 90*d*, and 90*e* correspondingly.

Each polarizer films 65, 85 has a transmission axis (not shown). When light travels to the polarizer films 65 or 85, light is linearly-polarized by the polarizer films 65 or 85 towards a direction of the transmission axis. In the embodiment, the transmission axis of the first polarizer film 65 is perpendicular to that of the second polarizer film 85. Accordingly, linear polarized light from the polarizer file 85 cannot pass through the other polarizer film 65 and cannot be observed from/at the polarizer film 65.

A surface of the transparent first glass substrate 60 define a plurality of annular first slots 602. The annular first slots 602 and the round hole 90*c* are coaxial. An electro-conductive film 60*a* is applied on each surface of the plurality of the annular slots 602. The transparent first glass substrate 60 further includes a first electrode S1. All the electro-conductive films 60*a* are electrically connected to the first electrode S1. The first electrode S1 is electrically connected to the circuit board 70.

A surface of the transparent second glass substrate 80 define a plurality of annular second slots 802 corresponding to the annular first slots 602. The annular second slots 802 and the round hole 90*b* are coaxial. An electro-conductive film 60*a* is also applied on each surface of the plurality of the annular second slots 802. Each annular second slot 802 defines an opening 803. The openings 803 are substantially aligned in a straight line. The transparent second glass substrate 80 further includes a plurality of second electrodes S2. Each end of the electro-conductive films 60*a* applied on each annular second slot 802 is electrically connected to a second electrode S2. The second electrode S2 is electrically connected to the circuit board 70.

The total amount of the annular first slots 602 is equal to that of the annular second slots 802. It should be noted that in assembly, the transparent first glass substrate 60 is attached to the transparent second glass substrate 80, and a receiving space (not shown) is defined/formed by each first slot 602 engaging with a corresponding second slot 802. The receiving space is configured to receive liquid crystal molecules (not shown). The first polarizer film 65 is attached to the first glass substrate 60 opposite to the first slots 602. The second polarizer 85 is attached to the second glass substrate 80 opposite to the second slots 802, and the illuminating device 95 is attached to the second polarizer film 85. After assembly, the round holes 90*a*, 90*b*, 90*c*, 90*d*, and 90*e* cooperatively form the through hole 90.

The illuminating device 95 emits light at the second polarizer film 85. A linearly-polarized light is formed after light passes through the second polarizer film 85 and travels in a direction of the transmission axis. When the first electrode S1 and the second electrodes S2 are not powered, the liquid crystal molecules are randomly distributed in each receiving space. The liquid crystal molecules turns the linearly-polarized light 90 degrees relative to the transmission direction of the linearly-polarized light. Because the transmission axis of the first polarizer film 65 is perpendicular to the second polarizer film 85, the linearly-polarized light passes through the first polarizer film 65 and is observable thereat. Thus the simulated iris 30 is lighted. In this state, only the simulated pupil 40 appears black, the size of black area is at the smallest, and the apparent pupil of the simulated eye 10 is in a normal state.

When the electrode S1 and the second electrodes S2 are powered, an electric field is formed between the first and second glass substrates 60, 80 and is perpendicular thereto. The liquid crystal molecules randomly distributed are aligned orderly by the electric field. Accordingly, the linearly-polarized light formed by the second polarizer film 85 travels through the first and second glass substrates 60, 80 in an initial direction. As the transmission axis of the first polarizer film 65 is perpendicular to that of the second polarizer film 85, thus, the linearly-polarized light can not pass through the first polarizer film 65, and the simulated iris 30 appears black. As a result, the size of black area expands, and the apparent pupil of the simulated eye 10 is said to change from the normal state to a dilated state. In the dilated state, the size of black area is a sum of that of the simulated pupil 40 and the first slots 602 and is largest.

When the first electrode S1 and the second electrodes S2 are not powered, the liquid crystal molecules are randomly distributed again in each receiving space, and the simulated iris 30 is lighted. Accordingly, the apparent pupil of the simulated eye 10 is changed from the dialed state to the normal state again.

Furthermore, the controller 20 can control the circuit board 70 to power the first electrode S1 and selectively power parts of the second electrodes S2 in a predetermined order from the inner most one toward the outermost one. When the first electrode S1 and parts of the second electrodes S2 are supplied with power, only a part of the first slots 602 appears black. Accordingly, when the second electrodes S2 are selectively powered in a predetermined order, the size of the black area enlarges gradually. As a result, the apparent pupil of the simulated eye 10 appears to dilate gradually. In reverse, the apparent pupil of the simulated eye 10 is contracted gradually when the second electrodes S2 are selectively powered off in reverse order.

Therefore, by selectively powering (on and off) the first electrode S1 and the second electrodes S2 to change the size of the colored area appearing in the simulated iris 30, the apparent pupil changes between a normal state and a dilated state.

In other embodiments, the transmission axis of the first polarizer film 65 can be parallel to the second polarizer film 85. The linearly-polarized light formed by one of the polarizer films 65, 85 can pass through the other polarizer film and is observed. When the first electrode S1 and parts of the second electrodes S2 are not powered, the liquid crystal molecules are randomly distributed in each receiving space, the liquid crystal molecules turn the linearly-polarized light formed by the second polarizer film 85 90 degrees, thus, the linearly-polarizer light cannot pass through the first polarizer film and is invisible thereat, and the simulated iris 30 appears black. As a result, the apparent pupil is dilated, and the simulated eye 10 is in a dilated state.

When the first electrode S1 and the second electrodes S2 are powered on, the liquid crystal molecules are aligned orderly, the linearly-polarized light formed by the second polarizer film 85 can pass through the first polarizer film 65 and is observed, and the simulated iris 30 is lighted. As a result, the simulated eye 10 is in a normal state. Furthermore, when the controller 20 control the circuit board 70 to supply the first electrode S1 with power and selectively to supply parts of the second electrodes S2 with power in sequence from the outermost one to the inner most one, the apparent pupil seems to be contracted gradually, and the simulated eye 10 is changed from the dilated state to the normal state gradually.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. A simulated eye, comprising:

a circuit board;

a controller electrically connected to the circuit board;

a simulated iris containing liquid crystal molecules and electrically connected to the circuit board, wherein the simulated iris defines a through hole; and a simulated pupil fixed to the circuit board and visible at the through hole of the simulated iris;

wherein when the simulated iris is supplied with electrical power, the liquid crystal molecules respond to an electric field generated by the electrical power, and a light transmission characteristic of light irradiated from the simulated iris is changed, such that a size of a colored area of the simulated iris is changed.

2. The simulated eye of claim 1, wherein the simulated iris comprises a first polarizer film, a first electro-conductive substrate, and a second electro-conductive substrate, a second polarizer film, the first electro-conductive substrate is attached to the second electro-conductive substrate to encapsulate the liquid crystal molecules therebetween, and the first and second polarizer films are attached to the first and second electro-conductive substrates correspondingly for changing a polarization direction of the light.

3. The simulated eye of claim 2, wherein at least one annular first slot is defined in the first electro-conductive substrate, at least one annular second slot is defined in the second electro-conductive substrate, and is corresponding to the at least one annular first slot, an electro-conductive film is prepared on a surface of each of the at least one first and second slots, the at least one first slot engages with the at least one second slot to form at least one receiving space, the receiving space is configured for receiving the liquid crystal molecules.

4. The simulated eye of claim 3, wherein the first electro-conductive substrate comprising a first electrode, the second electro-conductive substrate comprising at least one second electrode, the electro-conductive film prepared on the at least one first slot is electrically connected to the first electrode, the electro-conductive film prepared on the at least one second slot is electrically connected to the at least one second electrode correspondingly, the first and second electrodes are electrically connected to the circuit board.

5. The simulated eye of claim 3, wherein when the first electrode and the second electrodes are powered on, an electric field is formed between the first and second electro-conductive substrates and perpendicular thereto, and the liquid crystal molecules received in the receiving space are aligned orderly by the electric field.

6. The simulated eye of claim 2, wherein each the first and second polarizer comprises a transmission axis, when radiating light to one of the first and second polarizer films, a linearly-polarized light is formed after light pass the polarizer film and emits in a direction of the transmission axis thereof.

7. The simulated eye of claim 6, wherein the transmission axis of the first polarizer film is perpendicular to that of the second polarizer film.

8. The simulated eye of claim 6, wherein the transmission axis of the first polarizer film is parallel to that of the second polarizer film.

9. The simulated eye of claim 2, wherein the simulated iris further comprises an illuminating device, the illuminating device is attached to one of the polarizer films and is configured for emitting light travelling in a direction perpendicular to the first and second polarizer films toward the first and second electro-conductive substrates.

10. The simulated eye of claim 1, wherein the color of the simulated pupil is a dark color, and an initial color of the simulated iris is brown, and when the simulated iris is supplied with electrical power, the color of the simulated iris around the simulated pupil is darkened due to change of light transmission characteristic such that all the darkened area in the simulated iris and the simulated pupil are considered as a dilated pupil.

11. A simulated eye capable of being operated between a dilated state and a contracted state, the simulated eye comprising:

a circuit board;

a simulated iris defining a through hole, wherein the simulated iris comprises a first polarizer film, a first electro-conductive substrate, a second electro-conductive substrate, and a second polarizer film, the first and second polarizer films are attached to the first and second electro-conductive substrates correspondingly, the first and second electro-conductive substrates are fixed together to form at least one receiving space, and are both electrically connected to the circuit board, the at least one receiving space is configured for receiving liquid crystal molecules;

a simulated pupil visible at the through hole and attached to the circuit board; and a controller electrically connected to the circuit board;

wherein when the simulated iris is irradiated with light, a transmission direction of the light is changed by the first and second polarizer films engaging with the liquid crystal molecules, such that the light is shielded and/or observed, and the size of colored area of the simulated iris is changeable, whereby the simulated eye is changed between a normal state and the dilated state.

12. The simulated eye of claim 11, wherein the simulated iris further comprises an illuminating device, the illuminating device is attached to one of the polarizer films and is configured for emitting light travelling in a direction perpendicular to the first and second polarizer films toward the first and second electro-conductive substrates.

13. The simulated eye of claim 11, wherein at least one annular first slot is defined in the first electro-conductive substrate, at least one annular second slot is defined in the second electro-conductive substrate, and is corresponding to the at least one first slot, the at least one first slot engages with the at least one second slot to form the at least one receiving space.

14. The simulated eye of claim 11, wherein the first electro-conductive substrate comprises a first electrode, the second electro-conductive substrate comprises a plurality of second electrodes, the first and second electro-conductive substrates are electrically connected to the circuit board via the first and second electrodes respectively.

15. The simulated eye of claim 14, wherein when the first electrode and the second electrodes are powered on, an electric filed is formed between the first and second electro-conductive substrates, and the liquid crystal molecules received in the receiving space are aligned according to the electric field.

16. The simulated eye of claim 11, wherein each the first and second polarizer comprises a transmission axis, when radiating light to one of the first and second polarizer films, a linearly-polarized light is formed after light pass the polarizer film and emits in a direction of the transmission axis thereof.

17. The simulated eye of claim 16, wherein the transmission axis of the first polarizer film is perpendicular to that of the second polarizer film.

18. The simulated eye of claim 16, wherein the transmission axis of the first polarizer film is parallel to that of the second polarizer film.

19. The simulated eye of claim 11, wherein the color of the simulated iris is similar to that of the simulated pupil when there is no light pass through the simulated iris.

* * * * *